US005187842A

United States Patent [19]

Akashi et al.

[11] Patent Number: 5,187,842

[45] Date of Patent: Feb. 23, 1993

[54] SLIDER PULL TAB FOR SLIDE FASTENER

[75] Inventors: Shunji Akashi, Toyama; Yasushi Watanabe, Chiba, both of Japan

[73] Assignee: Yoshida Kogyo K. K., Tokyo, Japan

[21] Appl. No.: 846,705

[22] Filed: Mar. 6, 1992

[30] Foreign Application Priority Data

Mar. 6, 1991 [JP] Japan ..... 3-19730

[51] Int. Cl.[5] ..... A44B 19/00

[52] U.S. Cl. ..... 24/431; 24/419; 24/429

[58] Field of Search ..... 24/431, 419, 429, 415, 24/90 A, 163 K, 49 A; 294/3.6

[56] References Cited

U.S. PATENT DOCUMENTS

| | | | |
|---|---|---|---|
| 2,181,281 | 3/1938 | Morin . | |
| 4,052,773 | 10/1977 | Nesbitt | 24/163 K |
| 4,368,562 | 1/1983 | Minami | 24/431 |
| 4,471,510 | 9/1984 | DeRosa | 24/90 A |
| 4,790,050 | 12/1988 | Ishii | 24/419 |
| 4,873,750 | 10/1989 | Tracy . | |
| 4,984,338 | 1/1991 | Akashi | 24/431 |
| 5,007,144 | 4/1991 | Terada et al. | 24/431 |

FOREIGN PATENT DOCUMENTS

| | | | |
|---|---|---|---|
| 8002494 | 11/1980 | European Pat. Off. | 24/429 |
| 958604 | 1/1957 | Fed. Rep. of Germany . | |
| 2069317 | 8/1981 | United Kingdom . | |
| 2182977 | 5/1987 | United Kingdom . | |

*Primary Examiner*—Victor N. Sakran

*Attorney, Agent, or Firm*—Hill, Steadman & Simpson

[57] ABSTRACT

A slider pull tab, for a slide fastener, comprising a main plate of metal having a cutout extending from one edge to the center, and an ornamental plate of synthetic resin to be received in the cutout of the main plate. The main plate has a hollow portion communicating with the cutout, and also a locking hole through one of opposite side walls defining the hollow portion. The ornamental plate has a plug portion to be inserted into the hollow portion of the main plate, the plug portion having a locking claw to be resiliently locked with the locking hole. The ornamental plate is exchangeable with another.

2 Claims, 3 Drawing Sheets

SLIDER PULL TAB FOR SLIDE FASTENER

BACKGROUND OF THE INVENTION

1. Field of the Invention:

This invention relates a pull tab to be attached to a slider for a slide fastener, and more particularly to a slider pull tab provided with ornamental features and exchangeable with another.

2. Description of the Related Art:

Various kinds of slider pull tabs for slide fasteners have been developed to add ornamental features. Japanese Utility Model Laid-Open Publication No. 20219/1982 discloses one example of such slider pull tab which has an ornamental plate bearing an accessory feature and adhered to a recess on one surface of the pull tab. Japanese Utility Model Publication No. 42403/1986 discloses another example in which a metal pull tab is inserted in a hollow of a synthetic resin ornamental cap, there being a pair of locking projections at opposite sides of the hollow to lock the pull tab.

A common problem with the prior art types of slider pull tabs is that the ornamental plate or cap can be exchanged with another without difficulty. Another problem of the prior slider pull tabs is that the ornamental portion tends to be broken or otherwise damaged.

SUMMARY OF THE INVENTION

It is therefore an object of this invention to provide a slider pull tab, for a slide fastener, which is equipped with an ornamental plate exchangeable with another plate bearing a different design.

Another object of the invention is to provide a slider pull tab whose ornamental portion can be protected and which can be assembled with maximum ease.

According to this invention, there is provided a slider pull tab for a slide fastener, comprising: a main plate of metal having a cutout extending from at least one edge to its center; and an ornamental plate of synthetic resin to be received and resiliently locked in the cutout of the main plate.

Preferably, the main plate has a hollow portion contiguous to at least a part of the cutout edge and communicating with the cutout and also has a locking hole through one of opposite side walls defining the hollow portion. The ornamental plate has a plug portion to be inserted into the hollow portion of the main plate, the plug portion having a locking claw to be resiliently locked with the locking hole.

The ornamental plate is exchangeable with another ornamental plate having an identical shape and bearing a different design.

For assembly, the ornamental plate of synthetic resin is received and resiliently locked in the cutout of the main plate of metal. As the plug portion of the ornamental plate is inserted into the hollow portion of the main plate, the locking claw of the plug portion is resiliently engaged with the locking hole of the main plate. When the ornamental plate presently joined with the main plate is to be exchanged with another, the locking claw of the ornamental plate is depressed to be unlocked from the locking hole of the main plate, and then the ornamental plate can be removed from the main plate, whereupon another ornamental plate is joined with the main plate.

DETAILED DESCRIPTION

Embodiments of this invention will now be described with reference to the accompanying drawings.

Figure 1:
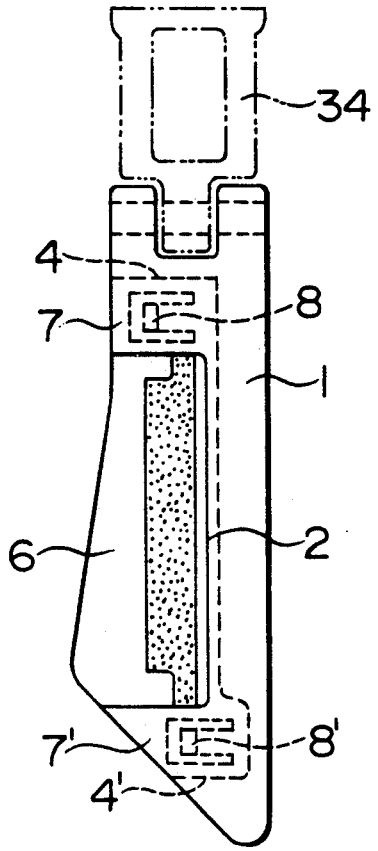
FIG. 1 is a plan view of a slider pull tab, for a slide fastener, according to a first embodiment of this invention.
Figure 2:
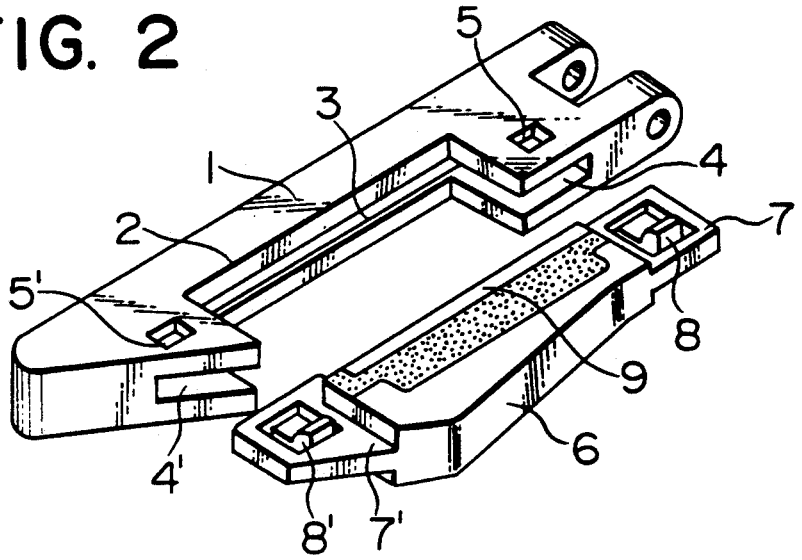
FIG. 2 is an exploded perspective view of FIG. 1.
Figure 3:
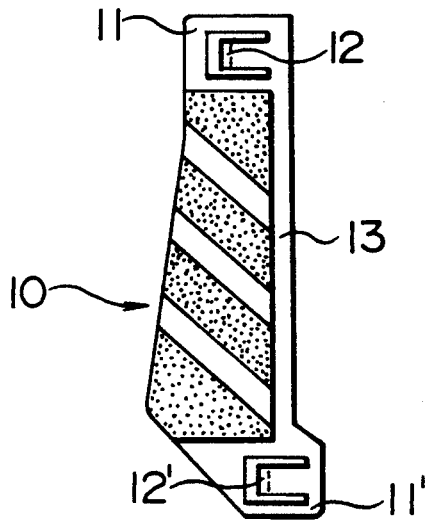
FIG. 3 a plan view of an ornamental plate having a different design for substitute for the ornamental plate of FIGS. 1 and 2.
Figure 4:
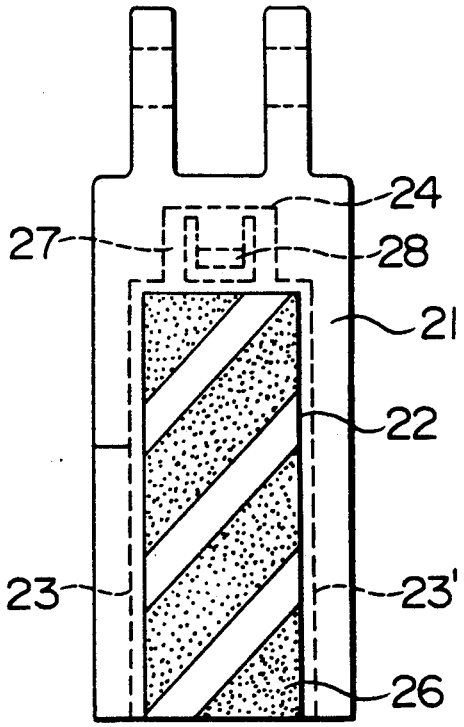
FIG. 4 is a plan view of a slider pull tab, for a slide fastener, according to a second embodiment.
Figure 5:
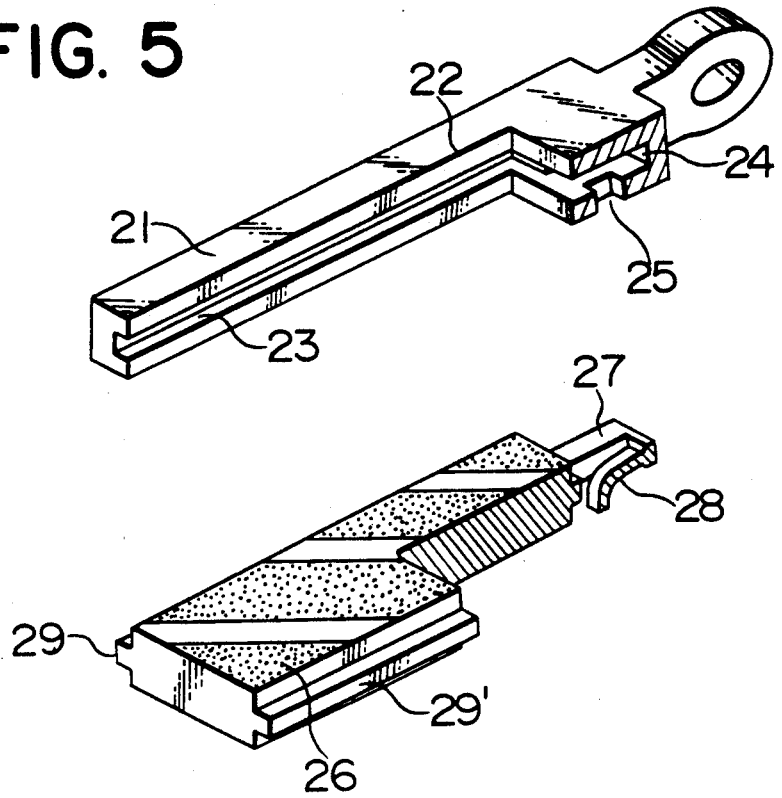
FIG. 5 is an exploded perspective view, with parts broken away, of FIG. 4.
Figure 6:
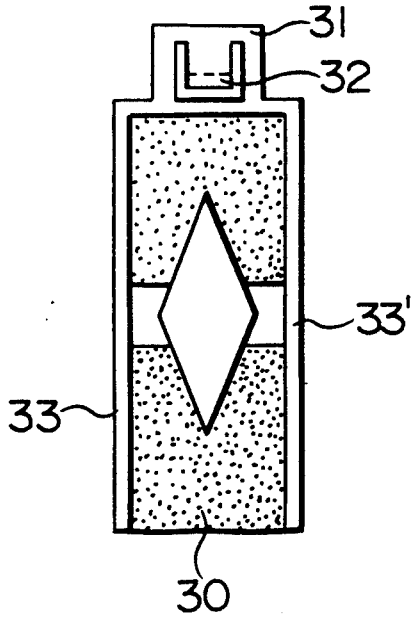
FIG. 6 is a plan view of an ornamental plate having a different design for substitute for the ornamental plate of FIGS. 4 and 5.

FIGS. 1 through 3 show a slider pull tab, for a slide fastener, according to a first embodiment, and FIGS. 4 through 6 show a slider pull tab, for a slide fastener, according to a second embodiment.

The slider pull tab of the first embodiment shown in FIGS. 1 through 3 generally comprises a main plate 1 of metal and an ornamental plate 6 of synthetic resin to be joined with the main plate 1. The main plate 1 has a cutout 2 extending from one side edge to the center, a groove 3 extending along the cutout edge, and a pair of hollow portions 4, 4' contiguous to opposite ends of the cutout 2 and communicating with the cutout 2. There is a pair of locking holes 5, 5' each extending through one (rear wall) of opposite walls defining the respective hollow portion 4, 4'. The ornamental plate 6 has at opposite ends a pair of plug portions 7, 7' to be inserted into the respective hollow portions 4, 4' of the main plate 1, each plug portion 7, 7' having a locking claw 8, 8' to be resiliently engaged with the respective locking hole 5, 5' of the main plate 1. Further the ornamental plate 6 has a ridge 9 extending along one side edge for being fitted in the groove 3 of the main plate 1.

The ornamental plate 6 has a multicolored design formed of synthetic resin. FIG. 3 shows another ornamental plate 10 having an identical shape and a different design, compared to the ornamental plate 6. The ornamental plate 10 has a pair of plug portions 11, 11' each having a locking claw 12, 12', there being a ridge 13 extending along one side edge of the ornamental plate 10. To exchange the ornamental plates 6, 10 with one another, the locking claws 8, 8' or 12, 12' are depressed against their resilience to be disengaged from the locking holes 5, 5', and then the ornamental plate 6 or 10 is removed from the main plate 1 for exchange with another.

The slider pull tab of the second embodiment shown in FIGS. 4 through 6 generally comprises a main plate 21 of metal and an ornamental plate 26 of synthetic resin to be joined with the main plate 21. The main plate 21 has a cutout 22 extending centrally from one end toward and terminating short of the other end or base, a pair of grooves 23, 23' extending along the opposite cutout edges, and a hollow portion 24 contiguous to the other end of the cutout 22 and communicating with the cutout 22. There is a locking hole 25 extending through one (rear wall) of opposite walls defining the hollow portion 24. The ornamental plate 26 has at the other end a plug portion 27 to be inserted into the hollow portion 24 of the main plate 21 and having a locking claw 28 to be resiliently engaged with the locking hole 25 of the main plate 21. Further the ornamental plate 26 has a pair of ridges 29, 29' extending along opposite side edges for being fitted in the respective grooves 23, 23' of the main plate 21.

FIG. 6 shows another ornamental plate 30 having an identical shape and a different design, compared to the ornamental plate 26. The ornamental plate 30 has a plug portion 31 having a locking claw 32, there being a pair of ridge 33, 33' extending along opposite side edges of the ornamental plate 30. To exchange the ornamental plates 26, 30 with one another, likewise in the first embodiment, the locking claw 28 or 32 is depressed against its resilience to be disengaged from the locking hole 25, and then the ornamental plate 26 or 30 is removed from the main plate 21 for exchange with another.

In FIG. 1, reference numeral 34 designates a clamp for attaching the pull tab to a slider body.

According to this invention, since the slider pull tab is a dividable type and is thus composed of the main plate of metal and the ornamental plate of synthetic resin, it is possible to manufacture an ornamented slider pull tab with ease. Since the main plate serves to protect the ornamental plate, it is possible to improve the durability of an ornamented slider pull tab. Further, since the ornamental plate can be exchanged with another according to the user's preference, this slider pull tab has an excellent ornamental value, compared to the conventional slider pull tab, so that it may be used as accessory.

What is claimed is:

1. A slider pull tab for a slide fastener, comprising:

(a) a main plate of metal having a cutout extending form its one edge to its center; and (b) an ornamental plate of synthetic resin to be received and resiliently locked in said cutout of said main plate, said main plate having a hollow portion contiguous to at least a part of the cutout edge and communicating with said cutout, said main plate also having a locking hole through one of opposite side walls defining said hollow portion, and said ornamental plate having a plug portion to be inserted into said hollow portion of said plate, said plug portion having a locking claw to be resiliently locked with said locking hole.

2. A slider pull tab according to claim 1, wherein said ornamental plate is exchangeable with another ornamental plate having an identical shape and bearing a different design.

* * * * *